US008905665B2

(12) United States Patent
Chang

(10) Patent No.: US 8,905,665 B2
(45) Date of Patent: Dec. 9, 2014

(54) RETRACTABLE WRITING AND ERASING PIECE AGAINST SLIDING BACK

(71) Applicant: Lion Pencil Co., Ltd., Banciao Dist., New Taipei (TW)

(72) Inventor: Hung-Jen Chang, Taipei (TW)

(73) Assignee: LION Pencil Co., Ltd. (TW)

( * ) Notice: Subject to any disclaimer, the term of this patent is extended or adjusted under 35 U.S.C. 154(b) by 1 day.

(21) Appl. No.: 13/846,808

(22) Filed: Mar. 18, 2013

(65) Prior Publication Data

US 2014/0003855 A1 Jan. 2, 2014

(30) Foreign Application Priority Data

Jul. 2, 2012 (TW) ..... 101212762 U

(51) Int. Cl.

| | |
|---|---|
| ***A45D 40/04*** | (2006.01) |
| ***B43K 24/00*** | (2006.01) |
| ***B43K 24/04*** | (2006.01) |
| ***B43K 24/06*** | (2006.01) |
| ***B43L 19/00*** | (2006.01) |
| ***A45D 40/12*** | (2006.01) |

(52) U.S. Cl.

CPC ..... *B43K 24/00* (2013.01); *B43K 24/04* (2013.01); *B43K 24/06* (2013.01); *B43L 19/0081* (2013.01); *A45D 40/04* (2013.01); *A45D 40/12* (2013.01)

USPC ..... 401/84; 401/78

(58) Field of Classification Search

USPC ..... 401/84, 75–78, 88, 98

See application file for complete search history.

(56) References Cited

U.S. PATENT DOCUMENTS 3,991,777 A * 11/1976 Powers et al. ..... 132/320
5,302,042 A * 4/1994 Ackermann ..... 401/74

* cited by examiner

*Primary Examiner* — David Walczak
(74) *Attorney, Agent, or Firm* — Merchant & Gould P.C.

(57) ABSTRACT

A retractable writing/erasing piece against sliding back includes a holding pipe, an internal pipe, a sleeve pipe, a slide base and a writing/erasing piece. At least a pair of stepped guide grooves is disposed on a pipe wall of the internal pipe and the stepped guide grooves have multiple guide groove windows. At least a pair of spiral guide slots is disposed on an internal wall of the sleeve pipe. At least a pair of guide protrusions is disposed on the slide base. The pair of guide protrusions is contained in the pair of spiral guide slots. The guide protrusions are abutted against a blocking wall of a guide groove window therein, so that an accident sliding back of the writing/erasing piece and the slide base can be avoided.

4 Claims, 7 Drawing Sheets

RETRACTABLE WRITING AND ERASING PIECE AGAINST SLIDING BACK

RELATED APPLICATIONS

This application claims priority to Taiwan Patent Application Serial Number 101212762, filed Jul. 2, 2012, which is herein incorporated by reference.

BACKGROUND

1. Field of Invention

The utility model relates to a retractable writing/erasing piece. More particularly, the utility model relates to a structure against sliding back of a retractable writing/erasing piece.

2. Description of Related Art

Retractable writing/erasing pieces, such as retractable lipsticks and retractable paint brushes, use the principle of spiral forced movement and guide groove limit to perform a rotation operation with a linear displacement function, so that an writing/erasing piece (such as a lipstick or a paint brush) can be moved in a retractable manner inside and outside a pipe body, for using or containing the writing/erasing piece.

Referring to FIG. 1, a conventional retractable writing/erasing piece 700 includes a holding pipe 710, an internal pipe 720, a sleeve pipe 730, a slide base 740 and an writing/erasing piece 750.

The internal pipe 720 has a fitting part 721 and a protruding part 722 along a length direction of the internal pipe 720. The fitting part 721 is fitted in an internal part of the holding pipe 710. A pair of straight guide grooves 723 in an opposite direction is disposed on a pipe wall of the protruding part 722. The sleeve pipe 730 covers an external part of the protruding part 722 of the internal pipe 720. A pair of spiral guide slots 731 in an opposite direction is disposed on an internal wall of the sleeve pipe 730. The slide base 740 is contained in an internal part of the protruding part 722 of the internal pipe 720 and a pair of guide protrusions 741 in an opposite direction is disposed on the slide base 740. The pair of guide protrusions 741 passes through the straight guide grooves 723 of the internal pipe 720 and are contained in the pair of spiral guide slots 731 of the sleeve pipe 730 in a protruding manner. The writing/erasing piece 750 is fixed on the slide base 740 and it can be moved with the slide base as a whole.

At the time of retractable use, a user holds the holding pipe 710 and the sleeve pipe 730 with the user's two hands respectively and rotates the holding pipe 710. The holding pipe can drive the internal pipe 720 to rotate as a whole. The internal pipe 720 forces the guide protrusions 741 of the slide base 740 to rotate in a spiral manner along the spiral guide slots 731 of the sleeve pipe 730 through the straight guide grooves 723 of the internal pipe 720. At the same time, the guide protrusions 741 of the slide base 740 are limited by the straight guide grooves 723 of the internal pipe 720 and can slide on straight paths of the straight guide grooves 723. That is, the slide base 740 may rotate in a spiral manner in the sleeve pipe 730 and the internal pipe 720 and slides straightly at the same time, so that the writing/erasing piece 750 fixed on the slide base 740 is retracted with the slide base 740.

However, as shown in FIG. 1, the conventional retractable writing/erasing piece has a drawback of sliding back at the time of erasing or writing. That is, for example, at the time of writing on a piece of paper, the writing force on the paper from the writing/erasing piece 750 may reversely influence the writing/erasing piece 750 and the slide base 740. For the internal pipe 720, which is used to fit with the slide base 740, the straight guide grooves 723 of the internal pipe 720 have a straight groove-shaped configuration and have no resisting structures against the reaction force of writing. Therefore, the reaction force used at the time of writing may force the writing/erasing piece 750 to retract inward very easily, resulting in the writing/erasing piece 750 to slide back. Furthermore, the inconvenient use is caused.

Referring to FIG. 2, in order to protect the writing/erasing piece 750, in general, a cover body 760 for covering may be prepared additionally. The conventional retractable writing/erasing piece 700 uses the cover body 760 to cover and fix an external part of the sleeve pipe 730, so that a linkage relation is formed between the cover body 760 and the sleeve pipe 730.

Such a covering structure of the cover body of the conventional retractable writing/erasing piece may have a drawback of maloperation. That is, when the cover body 760 covers and fixes the sleeve pipe 730, if the user holds the holding pipe 710 and the cover body 760 with the user's two hands respectively and rotates the holding pipe 710 or the cover body 760 accidentally, a relative rotation action will be made between the user and the internal pipe 720 linked to the holding pipe 710 and the sleeve pipe 730 linked to the cover body 760 and as a result the slide base 740 and the writing/erasing piece 750 thereon will be forced to retract accidentally as described above. At this time, the easer 750 protruding outward (such as a lipstick) may be abutted against an internal wall of the cover body 760, resulting in damages to the writing/erasing piece 750.

SUMMARY

The utility model provides a retractable writing/erasing piece, which can prevent itself from an accident sliding back at the time of use.

An aspect of the utility model provides a retractable writing/erasing piece against sliding back. The retractable writing/erasing piece includes a holding pipe, an internal pipe, a sleeve pipe, a slide base and a writing/erasing piece which are combined with each other. The internal pipe has a fitting part and a protruding part along a length direction of the internal pipe. The fitting part is fitted in an internal part of the holding pipe. At least a pair of guide grooves in an opposite direction is disposed on a pipe wall of the protruding part. The sleeve pipe covers an external part of the protruding part of the internal pipe. At least a pair of spiral guide slots in an opposite direction is disposed on an internal wall of the sleeve pipe. The slide base is contained in an internal part of the protruding part of the internal pipe and at least a pair of guide protrusions in an opposite direction is disposed on the slide base. The pair of guide protrusions passes through the guide grooves of the internal pipe and are contained in the pair of spiral guide slots of the sleeve pipe in a protruding manner. The writing/erasing piece is fixed on the slide base. A pair of guide grooves of the internal pipe is stepped guide grooves. Each stepped guide groove has multiple guide groove windows. Each guide groove window has a blocking wall in an opposite direction and adjacent guide groove windows are arranged in a stepped shape and connected to each other. At the time of erasing or writing, the guide protrusions of the slide base are abutted against a blocking wall of a guide groove window therein. Because of the resistance of the blocking wall, an accident sliding back of the writing/erasing piece and the slide base is avoided.

According to an embodiment of the utility model, a linkage mechanism is disposed between the holding pipe and the internal pipe, so that the internal pipe is moved with the holding pipe as a whole.

According to an embodiment of the utility model, the linkage mechanism includes an internal tooth and an external tooth which are engaged with each other. The internal teeth are disposed on an internal wall of the holding pipe while the external teeth are disposed on an external wall of the fitting part of the internal pipe. Due to the engagement of the internal tooth and the external tooth, a linkage relation is formed between the holding pipe and the internal pipe.

According to an embodiment of the utility model, the retractable writing/erasing piece against sliding back further includes a cover body, which covers an external part of the sleeve pipe and is fixed on an end of the holding pipe. According to this, the cover body is not related to the sleeve pipe so as to avoid damages to the writing/erasing piece due to a maloperation when the cover body is in a covering state.

DETAILED DESCRIPTION

Figure 1:
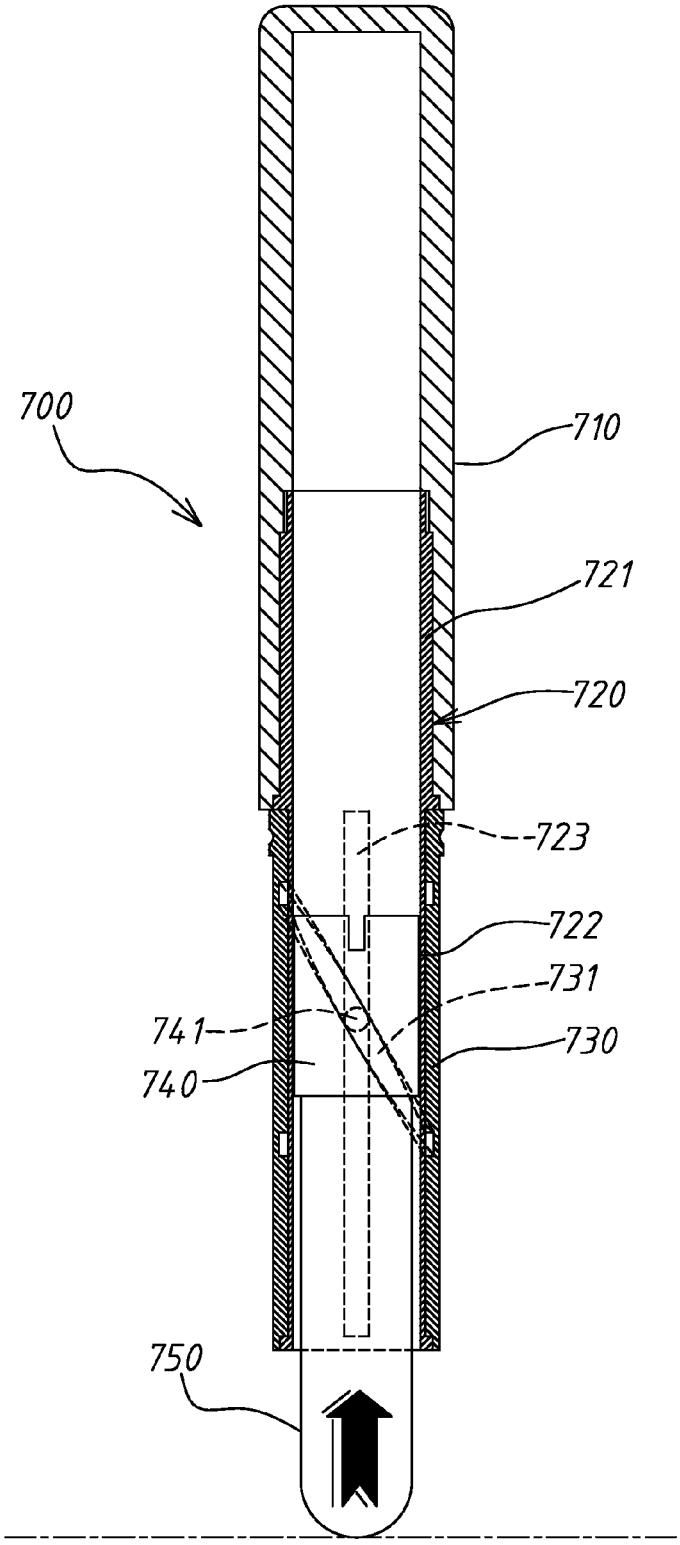
Fig. 1 ( PRIOR ART )
FIG. 1 illustrates a sectional view of a conventional retractable writing/erasing piece and shows a schematic view of use of the writing/erasing piece.
Figure 2:
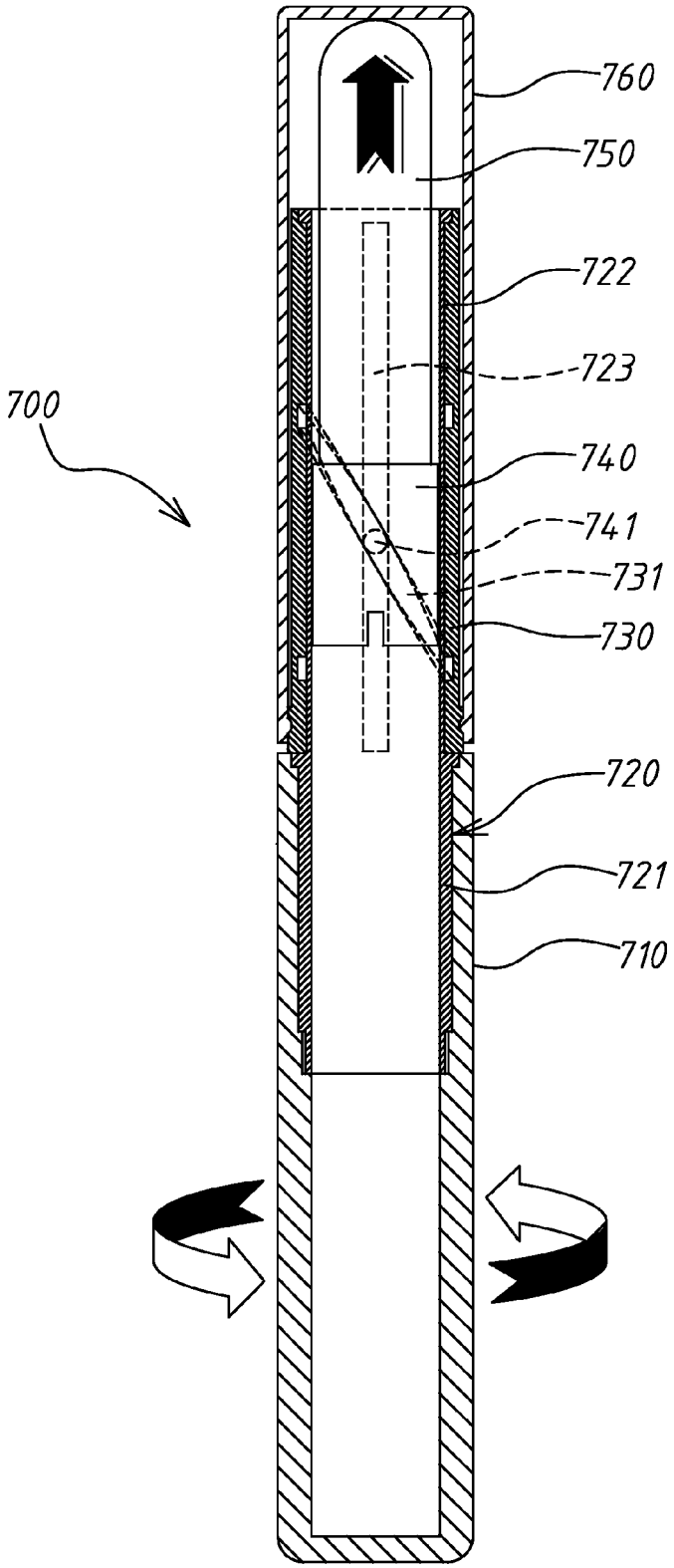
Fig. 2 ( PRIOR ART )
FIG. 2 illustrates a sectional view of the conventional retractable writing/erasing piece shown in FIG. 1 when a cover body of the writing/erasing piece is covered and shows a schematic view of use of the writing/erasing piece.

The foregoing and other technical contents, features and effects of the utility model may be clearly shown in the following detailed description of embodiments with reference to the accompanying drawings.

Referring to FIG. 3 to FIG. 7, according to an embodiment of the utility model, a retractable writing/erasing piece against sliding back includes: a holding pipe 100, an internal pipe 200, a sleeve pipe 300, a slide base 400 and an writing/erasing piece 500. The creation feature of the utility model is the configuration of the stepped guide grooves 230 in the internal pipe 200, and the structure thereof will be described in details as follows.

The internal pipe 200 has a fitting part 210 and a protruding part 220 along the length direction of the internal pipe 200. The fitting part 210 is fitted in an internal part of the holding pipe 100. In order to form a linkage relation between the holding pipe 100 and the internal pipe 200, a linkage mechanism 120 is disposed between the holding pipe 100 and the internal pipe 200. The linkage mechanism 120 includes an internal tooth 121 and an external tooth 122 which are engaged with each other. The internal tooth 121 is disposed on an internal wall of the holding pipe 100 while the external tooth 122 is disposed on an external wall of the fitting part 210 of the internal pipe 200. According to this, when the holding pipe 100 rotates, the internal pipe 200 will be driven to rotate as a whole.

A pair of stepped guide grooves 230 in an opposite direction is disposed on a pipe wall of the protrusion part 220. Each stepped guide groove 230 has multiple guide groove windows 231. Each guide groove window has a blocking wall 232 in an opposite direction and adjacent guide groove windows are arranged in a stepped shape and connected to each other. .

The sleeve pipe 300 covers an external part of the protruding part 220 of the internal pipe 200. A pair of spiral guide slots 310 in an opposite direction is disposed on an internal wall of the sleeve pipe 300.

The slide base 400 is contained in an internal part of the protruding part 220 of the internal pipe 200 and a pair of guide protrusions 410 in an opposite direction is disposed on the slide base 400. The pair of guide protrusions 410 passes through the stepped guide grooves 230 of the internal pipe 200 and are contained in the pair of spiral guide slots 310 of the sleeve pipe 300 in a protruding manner.

The writing/erasing piece 500, such as a lipstick or a paintbrush, is fixed on the slide base 400 and it can be moved with the slide base as a whole.

Figures 8, 9:
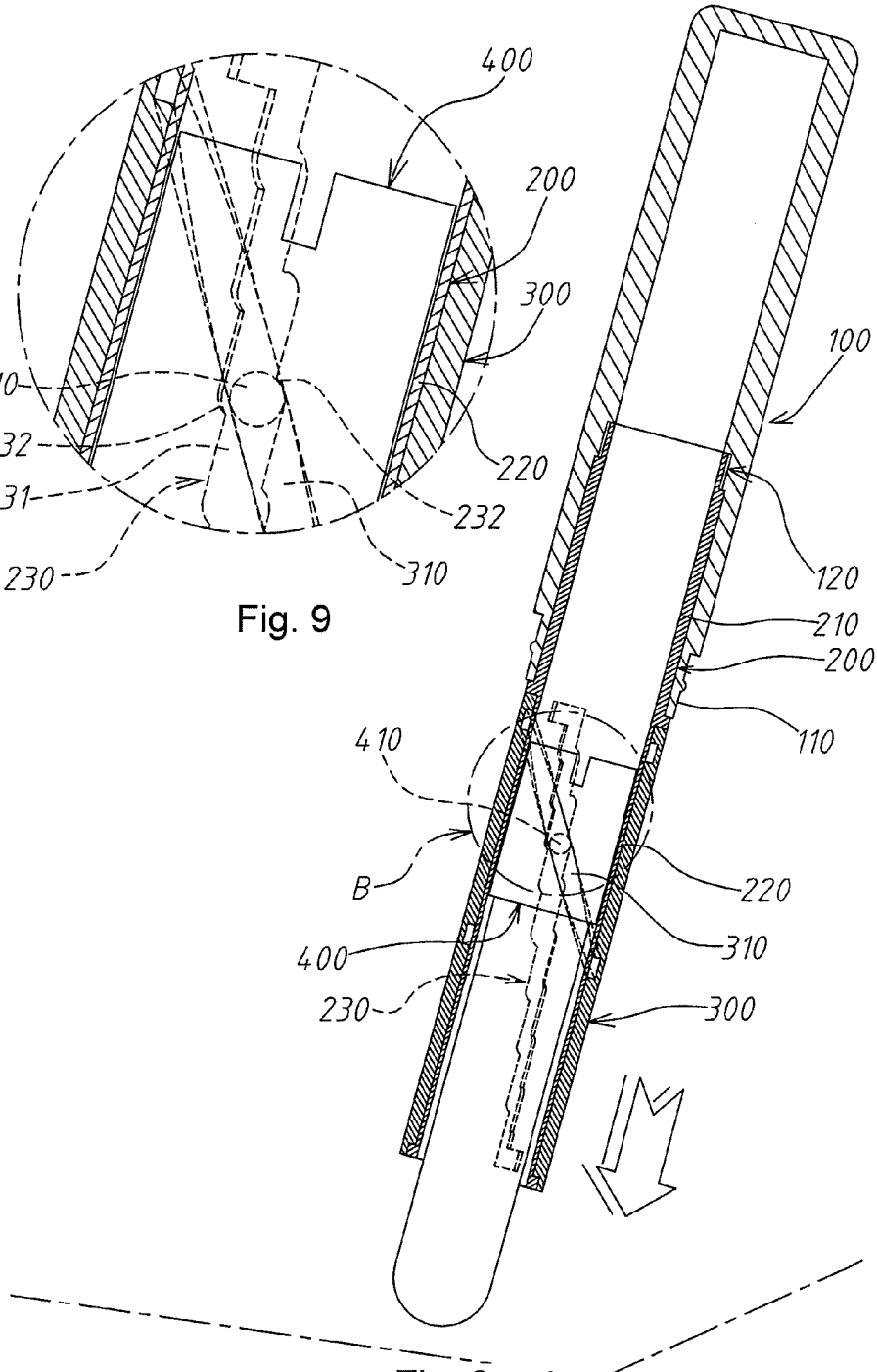
FIG. 8 illustrates a sectional view of the retractable writing/erasing piece against sliding back shown in FIG. 3 and shows a schematic view of use of the writing/erasing piece.
FIG. 9 illustrates an enlarged view of a part B in the retractable writing/erasing piece against sliding back shown in FIG. 8.

Referring to FIG. 8 and FIG. 9 together, when the retractable writing/erasing piece against sliding back of the utility model is used, the user holds the holding pipe 100 and the sleeve pipe 300 with the user's two hands respectively and rotates the holding pipe 100. The holding pipe can drive the internal pipe to rotate as a whole. The internal pipe 200 forces the guide protrusions 410 of the slide base 400 to rotate in a spiral manner along the spiral guide slots 310 of the sleeve pipe 300 through the stepped guide grooves 230 of the internal pipe 200. At the same time, the guide protrusions 410 of the slide base 400 are limited by the stepped guide grooves 230 of the internal pipe 200 and can slide on the almost straight stepped paths of the stepped guide grooves 230. That is, the slide base 400 may rotate in a spiral manner in the sleeve pipe 300 and the internal pipe 200 and slides in an almost straight manner at the same time, so that the writing/erasing piece 500 fixed on the slide base 400 is moved with the slide base 400 in a retractable manner.

When the writing/erasing piece 500 is used for erasing or drawing and writing, for example, being used for writing on a piece of paper, although the writing force on the paper from the writing/erasing piece 500 may reversely influence the writing/erasing piece 500 and the slide base 400, each guide groove window 231 of the stepped guide grooves 230 of the internal pipe 200 used for fitting with the slide base 400 has a blocking wall 232. When the writing/erasing piece 500 is used for writing, the guide protrusion 410 of the slide base 400 is abutted against the blocking wall 232 of a guide groove window 231 therein. Because of the resistance of the blocking wall 232, an accident sliding back of the writing/erasing piece 500 and the slide base 400 is avoided.

When the writing/erasing piece 500 and the slide base 400 are to be retracted really after the completion of writing, the holding pipe 100 must be reversed deliberately so as to relief the straight resistance against the guide protrusions 410 of the slide base 400 from the blocking wall 232 of the stepped guide groove 230 of the internal pipe 200, so that the writing/erasing piece 500 and the slide base 400 can be made to retract into the internal pipe 200.

Figure 3:
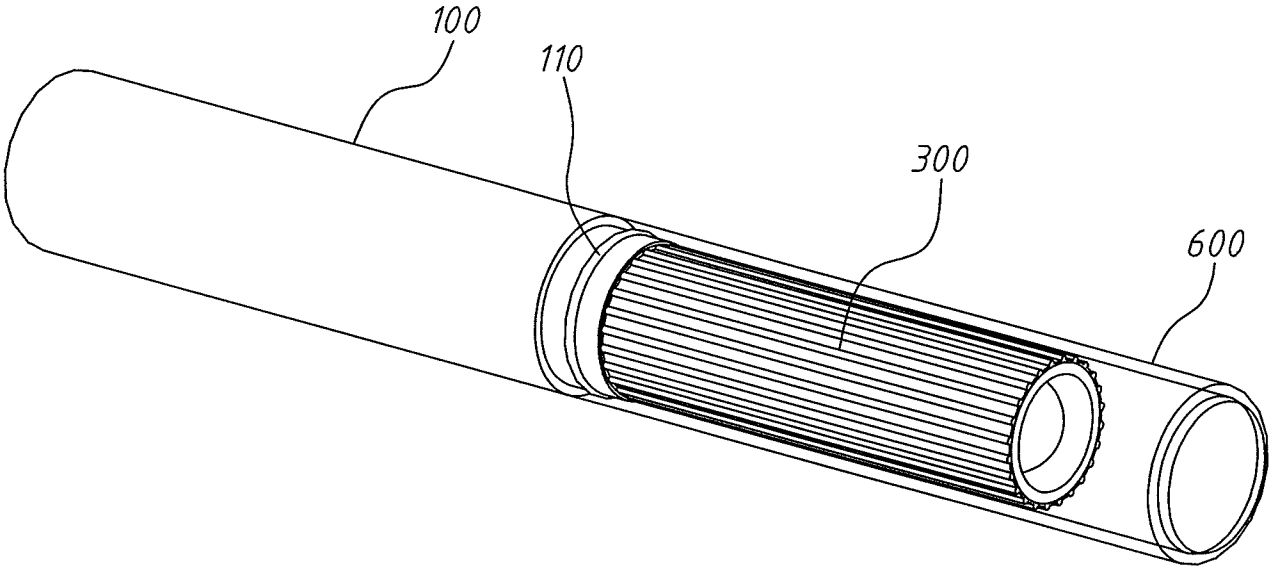
FIG. 3 illustrates an appearance view of a retractable writing/erasing piece against sliding back according to an embodiment of the utility model.
Figure 4:
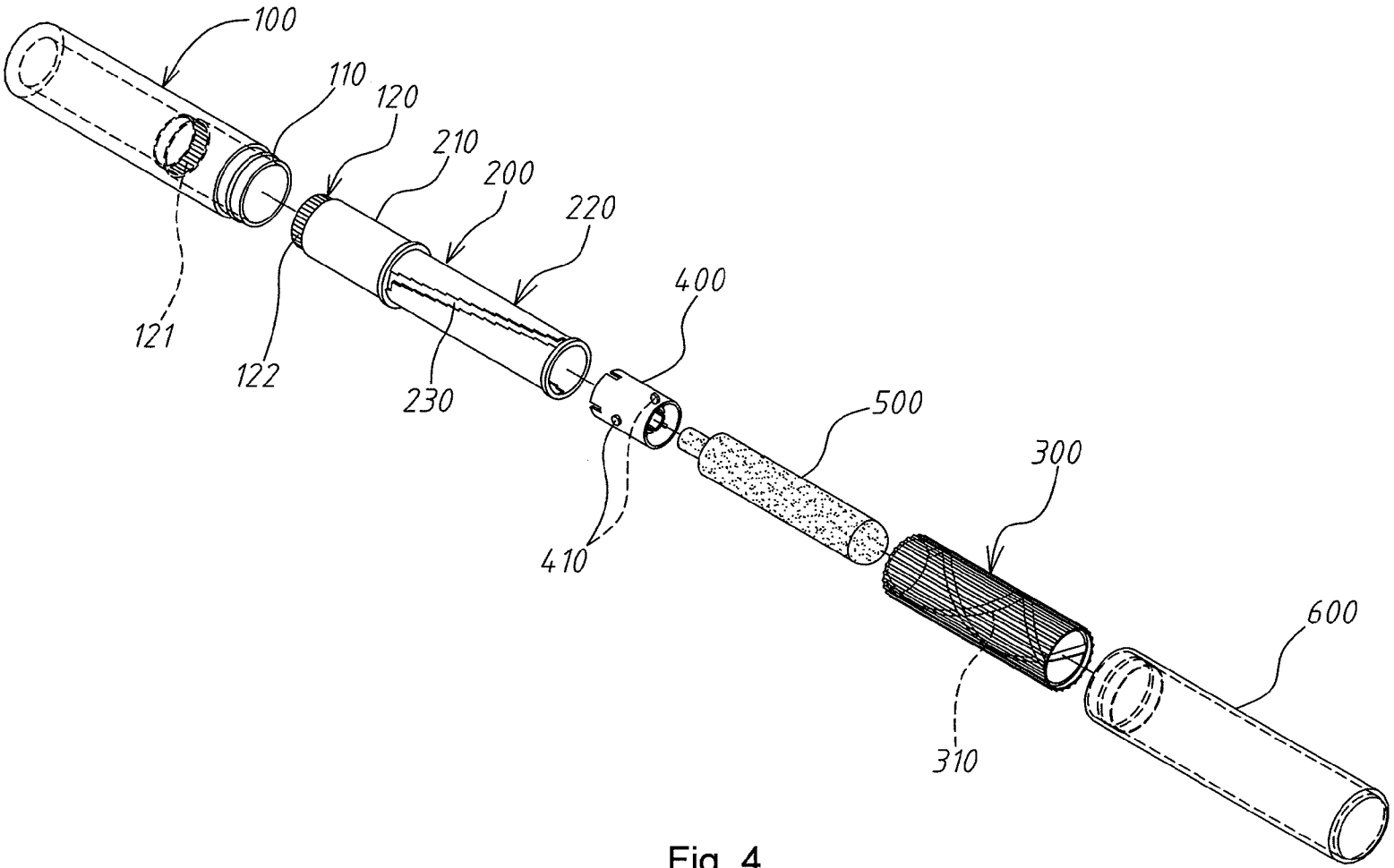
FIG. 4 illustrates an exploded view of the retractable writing/erasing piece against sliding back shown in FIG. 3.
Figure 5:
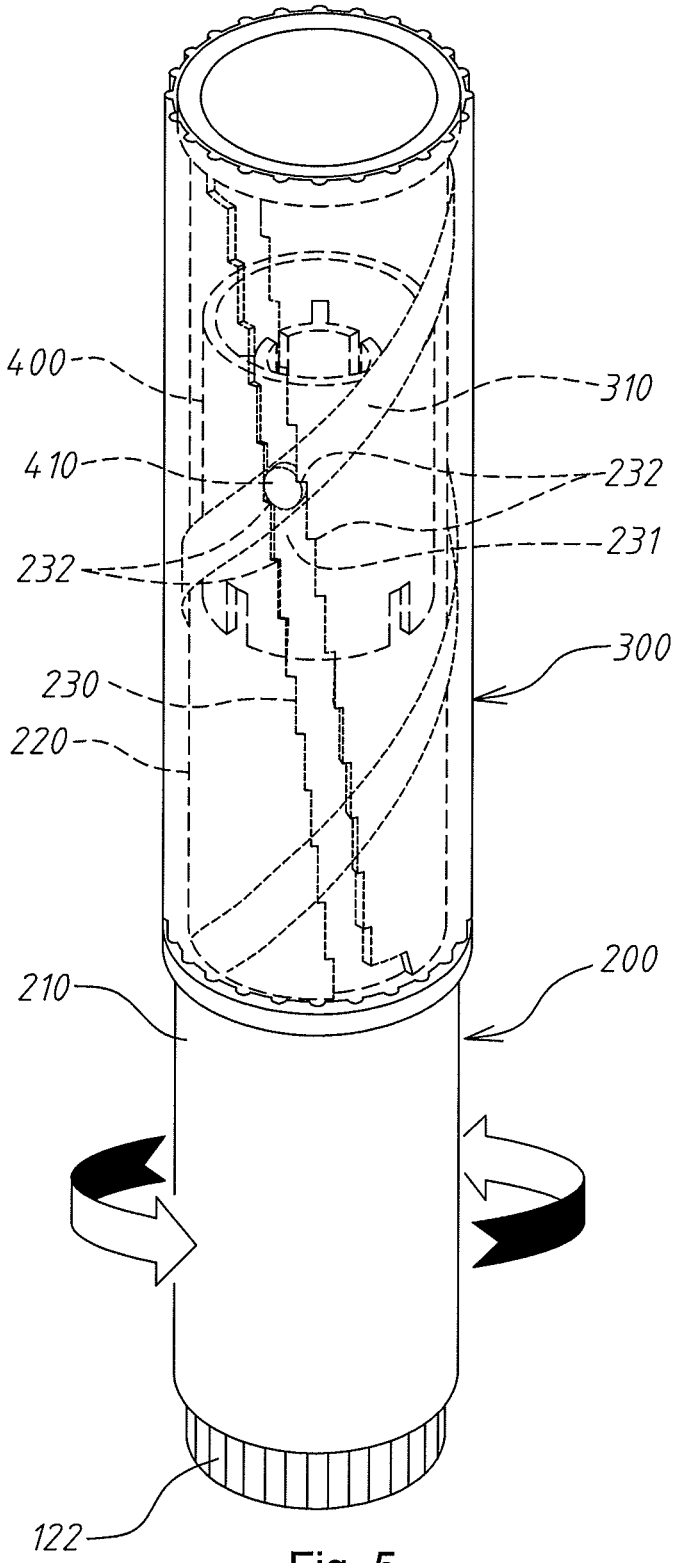
FIG. 5 illustrates a combination view of an internal pipe, a sleeve pipe and a slide base in the retractable writing/erasing piece against sliding back shown in FIG. 4.
Figure 7:
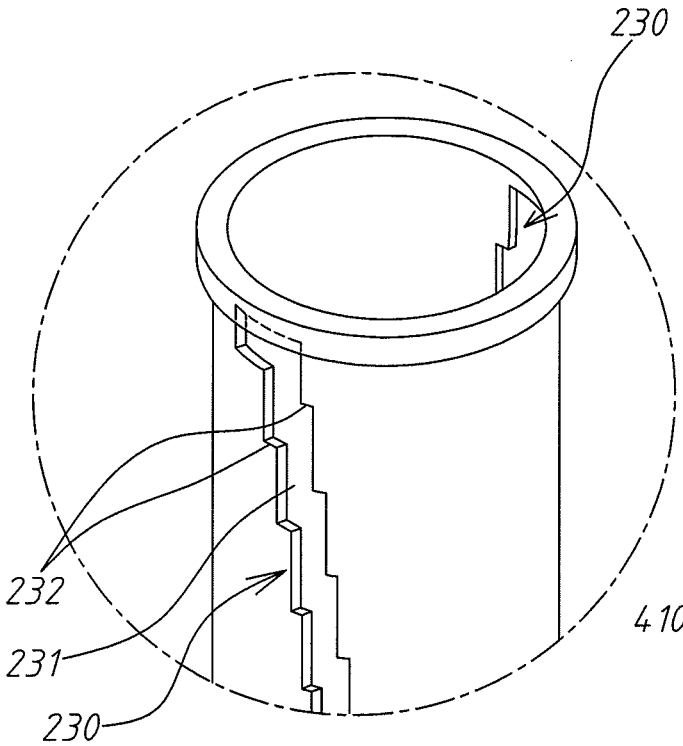
FIG. 7 illustrates an enlarged view of a part A in the internal pipe shown in FIG. 6.
Figure 6:
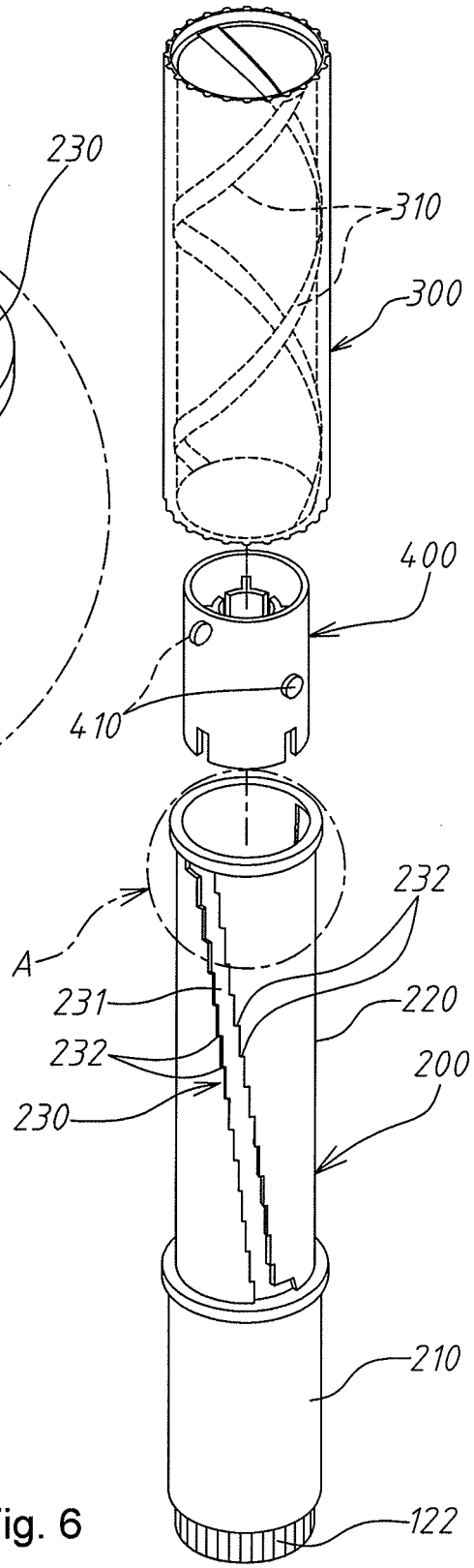
FIG. 6 illustrates an exploded view of the internal pipe, sleeve pipe and slide base shown in FIG. 5.

Referring to FIG. 3 and FIG. 4, according to an embodiment of the utility model, a retractable writing/erasing piece against sliding back further includes a cover body 600 for protecting the writing/erasing piece 500. The cover body 600 covers an external part of the sleeve pipe 300 and is fixed on an end 110 of the holding pipe 100. That is, the cover body 600 is not combined with the sleeve pipe 300. Therefore, when the cover body 600 covers the sleeve pipe 300, if the user holds the holding pipe 100 and the cover body 600 with the user's two hands respectively and rotates the holding pipe 100 or the cover body 600 accidentally, the holding pipe 100 and the cover body 600 only rotate by themselves without a rotation relative to the sleeve pipe 300. Consequently, the slide base 400 and the writing/erasing piece 500 will not be driven to protrude outward, so that it can be avoided that the protruding writing/erasing piece 500 is abutted against an internal wall of the cover body 600, resulting in damages to the writing/erasing piece 500.

According to an embodiment of the utility model, a retractable writing/erasing piece against sliding back can prevent itself from sliding back due to the stepped guide grooves 230 disposed in the internal pipe 200 of the writing/erasing piece. Additionally, according to the combination relation of the cover body 600 and the holding pipe 100, the cover body 600 is not related to the sleeve pipe 300 so as to avoid damages to the writing/erasing piece 500 due to a maloperation when the cover body 600 is in a covering state.

What is claimed is:

1. A retractable writing/erasing piece against sliding back, comprising:

a holding pipe;

an internal pipe, wherein the internal pipe has a fitting part and a protruding part along a length direction of the internal pipe, the fitting part is fitted in an internal part of the holding pipe, at least a pair of guide grooves is disposed on opposite sides of a pipe wall of the protruding part, each of the guide grooves is a stepped guide groove, which is stepped on both sides of the guide groove, each of the stepped guide grooves has multiple guide groove windows, each guide groove window has a blocking wall adjacent thereto, adjacent guide groove windows of the guide groove windows are arranged in a stepped shape and are connected to each other;

a sleeve pipe, which covers an external part of the protruding part of the internal pipe, wherein at least a pair of spiral guide slots in an opposite direction is disposed on an internal wall of the sleeve pipe;

a slide base, which is contained in an internal part of the protruding part of the internal pipe, wherein at least a pair of round guide protrusions in an opposite direction is disposed on the slide base, the pair of round guide protrusions passes through the guide grooves of the internal pipe and is contained in the pair of spiral guide slots of the sleeve pipe in a protruding manner; and an writing/erasing piece, fixed on the slide base.

2. The retractable writing/erasing piece against sliding back of claim 1, wherein a linkage mechanism is disposed between the holding pipe and the internal pipe.

3. The retractable writing/erasing piece against sliding back of claim 2, wherein the linkage mechanism comprises an internal tooth and an external tooth which are engaged with each other, the internal tooth is disposed on an internal wall of the holding pipe and the external tooth is disposed on an external wall of the fitting part of the internal pipe.

4. The retractable writing/erasing piece against sliding back of claim 1, further comprising a cover body which covers an external part of the sleeve pipe and is fixed on an end of the holding pipe.

* * * * *